US006203217B1

(12) United States Patent
Glogovsky

(10) Patent No.: US 6,203,217 B1
(45) Date of Patent: Mar. 20, 2001

(54) SYSTEM AND METHOD FOR NOTIFYING ITINERANTS OF FILM DEVELOPMENT

(75) Inventor: Terence M. Glogovsky, Sugar Hill, GA (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/604,495

(22) Filed: Jun. 27, 2000

(51) Int. Cl.[7] ..... G03D 11/00
(52) U.S. Cl. ..... 396/564; 396/567; 396/578
(58) Field of Search ..... 396/567, 568–570, 396/578, 2; 355/32, 38, 40, 41, 77, 27–29; 705/8

(56) References Cited

U.S. PATENT DOCUMENTS 5,666,215 * 9/1997 Fredlund et al. ..... 358/487
5,760,917 * 6/1998 Sheridan ..... 358/442
5,974,393 * 10/1999 McCullough et al. ..... 705/8

* cited by examiner

*Primary Examiner*—D. Rutledge
(74) *Attorney, Agent, or Firm*—Maginot, Addison & Moore

(57) ABSTRACT

A system and method provide reliable and effective notification to itinerants that film rolls they have deposited at a place of lodging or a point-of-interest site for processing have been returned to the itinerant's place of lodging and are available for retrieval. A system that provides such notification for film deposited at a place of lodging includes a data capture device for reading customer identification data from an itinerant's electronic room key and film roll data from a film roll. A data server coupled to the data capture device stores the data in a data repository that accompanies the film roll to the film processing site. The data server also generates a data record for storage in a database. Upon return of the developed film, a notification message generator generates a notification message to the itinerant regarding return of the developed film roll. The notification message may be delivered to the itinerant via a voicemail box assigned to the guest room for the itinerant at the place of lodging or through a text messaging system at the place of lodging that delivers text messages to the television in the itinerant's guest room.

20 Claims, 5 Drawing Sheets

SYSTEM AND METHOD FOR NOTIFYING ITINERANTS OF FILM DEVELOPMENT

CROSS REFERENCE

Cross reference is made to copending U.S. patent applications Ser. No. 09/604,493 entitled "System and Method for Notifying Customers of Film Development" by Terence M. Glogovsky and Ser. No. 09/604,494 entitled "System and Method for Identifying Film Rolls During Development Processing" by Glogovsky et al., both of which are assigned to the same assignee as the present invention, and both are filed concurrently herewith.

FIELD OF THE INVENTION

This invention relates generally to methods and systems for tracking items entrusted to an establishment for service or repair and, more particularly, to methods and systems for tracking film entrusted to an establishment for development.

BACKGROUND OF THE INVENTION

Many casual photographers use camera film that they have developed by commercial vendors. These vendors typically have the customers write data onto an envelope in which their photographs and negatives are returned. The film roll container is then placed in the envelope and sent to a photo processing lab. At the lab, the film roll is developed and the negatives and developed photographs are sealed in the envelope from which the film was retrieved. The envelope is then returned to the vendor's location where the customer deposited the film roll container, which is typically a retail store.

When a customer deposits the film roll container, a sign usually informs the customer that film deposited on that day is returned to that location on a particular date. The customer then knows to return to the store on or after that date to pick up the developed film and photographs. This method puts the onus on the customer to check with the store and see if the film has been returned from the processing lab. Customer frustration arises whenever the customer returns after the designated date for the developed photographs and the envelope with the developed film is not available. A variety of reasons exist for this problem. For one, the photo processing lab may have been inundated with significant number of film containers and delays in processing occur from the unanticipated volume. For example, holidays and graduations cause people to take many photographs and submit their film for development. Customers are informed by the personnel at the deposit location that they are unaware of the cause of the delay at the processing lab and that the customer must call or return to the deposit location at a later time for the processed film. Other reasons for film processing delays include development equipment failure and errors in handling film rolls during processing.

In fact, one of the most frustrating times for customers to try to obtain film processing for their exposed film rolls is when they are itinerant such as when they are on vacation or otherwise away from home. Turnaround time for film development may prevent a customer from depositing film with a vendor for processing because the customer may leave the locale by the time the film rolls are returned. Even if the turnaround time for processing appears to be within the customer's time of visitation, the customer may not entrust the film to a vendor because the customer fears the reliability of the appointed time for developed roll return. Additionally, some customers who stay in hotels, motels, or other places of lodging may be concerned about leaving information about the location of their accommodations in a legible form with vendor personnel who may unscrupulously use the information. Also, some customers do not deposit film rolls for development with vendors because they do not want to bother with scheduling retrieval of the developed film during the daily events of a pleasure trip.

Theme parks and other point-of-interest sites have an incentive to encourage visitors to take photographs because they frequently sell disposable cameras, camera accessories, or film supplies at kiosks in the park. If visitors were able to see developed photographs during their visit, they may seek more opportunities to take photographs and otherwise increase their use of photography equipment and supplies. Some theme parks are able to accept film rolls for development but visitors, for reasons already noted, are leery about leaving film rolls for development at locations remote from their homes.

Another customer problem may occur when a customer deposits more than one film container. Each film container requires a separate envelope. Handling of the envelope, either during shipment or processing, by various personnel may cause envelopes containing film containers deposited at the same time to be separated. Consequently, the film may be processed at different times and returned to the location where they were deposited at different times. Again, the customer must check with the deposit location until all of the envelopes are returned. If the customer wants to view some of the photographs before all of them are returned, multiple trips must be made to the deposit location. Frustration with multiple trips or telephone calls to determine when a customer may retrieve developed photos may cause a customer to shop and have film developed at a business other than the deposit location.

One way of addressing these problems would be to notify customers directly when envelopes containing their developed film have been received at the location where the film was deposited. Such service would require someone to inventory the received envelopes each day. Then the person would need to call each person identified on the envelope to inform them of the arrival of the envelope. If the customer's phone was busy or the customer did not have an answering machine, the person at the deposit location may expend a significant amount of time on the notification tasks rather than tasks that might contribute more directly to the profitability of the business. Consequently, the overhead costs associated with such service are usually deemed too cost prohibitive for implementation of such service. Even if such service were not cost prohibitive, it would not address the problems perceived by visitors regarding the development of film rolls exposed during their pleasure trips.

What is needed is a way of making customers away from their homes feel secure about leaving film rolls with vendors for development.

What is needed is a way of facilitating return of developed film rolls to customers away from their homes so it does not inconvenience them or disrupt their pleasure trips.

SUMMARY OF THE INVENTION

The above-noted limitations of previously known methods for receiving and returning developed film to customers away from their homes have been overcome by a system and method that operate in accordance with the principles of the present invention. The method of the present invention includes reading customer identification data from an electronic room key, storing the customer identification data in a data repository that accompanies a film roll container, reading customer identification data from the data repository after development of the film roll in the film container, and generating a notification message for delivery to an itinerant corresponding to the customer identification data. In this manner, the itinerant is informed that a developed film roll is available for retrieval at a hotel site. The customer identification data is preferably encoded before being stored in the data repository so the customer data is not legible to humans viewing the repository. Entry of the data for storage in the data repository may be performed by a customer or hotel site employee through a keypad or through a scanning device that reads a customer's electronic room key.

The method may be implemented with a system made in accordance with the principles of the present invention. The system includes a data capture device for reading customer identification from an electronic room key, a data server for storing the data in a data repository, and a notification message generator for generating after development of the film roll, a notification message to the customer corresponding to the customer identification data. The data capture device may be a keypad or barcode reader at the film container deposit site. Data identifying the customer may be entered manually through the keypad by employees of the site or by a customer responding to questions displayed on a screen located near the keypad. Preferably, the data capture device is a barcode reader so the customer's electronic key may be read to obtain the customer identification data encoded on the key when the customer registered with the hotel. Alternatively, the data identifying the guest room of the itinerant may be transferred from the hotel's computer to a data repository upon manual entry of the guest's identification. A data server may use the customer identification data to generate a data repository such as a printed label having encoded data that identifies the customer, the film container, and the hotel. This label may be applied to an envelope in which the film container is placed or it may be applied directly to the film container. The data may be encoded as a bar code or other unencrypted data or the encoding may include encryption for additional data security. Once the film has been developed at a photo processing lab, the data may be read from the label and used by a server at the photo processing lab to generate status update messages. The status update messages may be electronic mail (email) messages that are sent to the server at the itinerant's place of lodging. The server at the hotel may send to the customer as notification messages one or more of the status messages received from the photo processing lab, if ongoing status updates to the itinerant are desired. Notification messages may be voice mail messages that are delivered to the customer through the hotel's automated voice attendant or text messages delivered through the hotel's messaging system that displays text messages on a television in a guest's room. Notification that the developed roll is available for retrieval is generated by the server at the hotel in response to delivery of the developed film roll to the hotel. The notification message(s) may be delivered to a customer as voice mail or as a visual message displayed by the hotel's messaging system on the customer's room television. Once a customer receives the notification message, the customer may confidently retrieve the developed photographs from the hotel desk.

In another embodiment of the present invention, a data capture device is located at a theme park or other point-of-interest site. There the customer may deposit a film roll and the data capture device may be used to scan the customer's electronic room key for customer identification data. A data server coupled to the data capture device may be used to encode the customer data and store it in a data repository associated with the film roll. At the lab processing site, the data repository accompanying the film roll may be scanned after the roll is developed to determine where the developed film is to be delivered. Upon delivery of the developed film to the identified hotel, a data capture device scans the data repository so a data server at the hotel may generate a notification message. The message may be delivered via voice mail or the visual message system to the customer's room. The customer may then retrieve the developed film from the hotel desk. Additionally, the data servers at the theme park or other point-of-interest site may send status messages to one another at various events in the process so data records stored at each data server may be updated and/or deleted.

It is an object of the present invention to provide notification to itinerants regarding the availability of developed film rolls for retrieval at the place of lodging.

It is an object of the present invention to provide availability notification to an itinerant regarding each film roll deposited by a customer at a place of lodging or a point-of-interest site.

It is an object of the present invention to provide a deposit site for film roll processing at theme parks or the like.

These and other advantages and features of the present invention may be discerned from reviewing the accompanying drawings and the detailed description of the invention.

BRIEF DESCRIPTION OF THE DRAWINGS

The present invention may take form in various circuit and method components and arrangement of circuit and method components. The drawings are only for purposes of illustrating an exemplary embodiment and are not to be construed as limiting the invention.

DETAILED DESCRIPTION OF THE INVENTION

Figure 1:
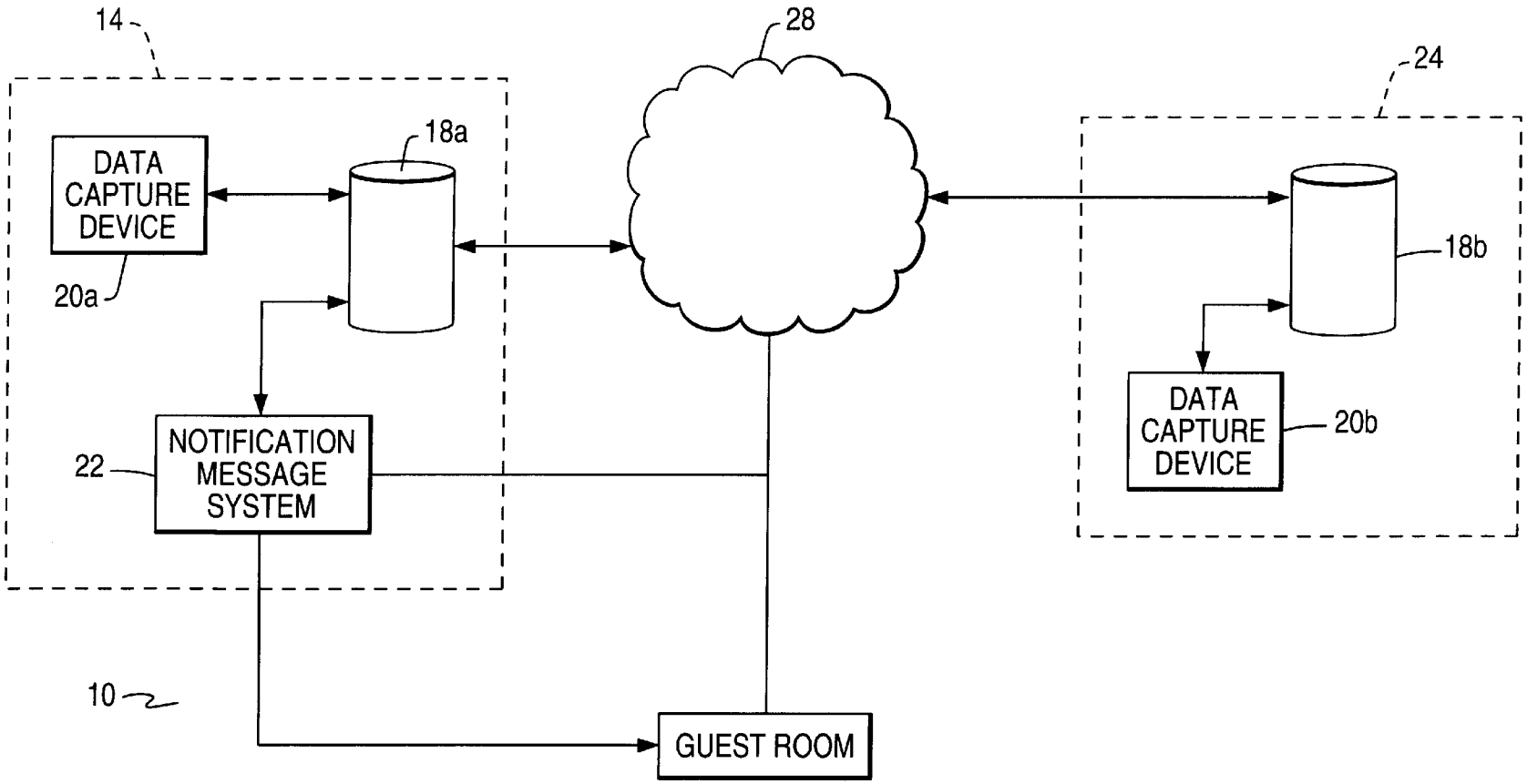
FIG. 1 depicts a block diagram of a system that may be used to notify an itinerant of a developed film roll being available for retrieval.

A system embodying the present invention is shown in FIG. 1. System 10 may include a hotel site 14, a lab site 24, and a customer's room at the hotel. Hotel site 14 includes a data server 18*a*, a data capture device 20*a*, and a notification message system 22. Data capture device 20*a* is operatively coupled to server 18*a* and may be a barcode or magnetic stripe reader to read customer information stored on a customer's electronic room key. Data capture device 20*a* may also be a keypad through which a customer or hotel employee may enter customer and film roll data. Alternatively, entry of some type of customer identifier such as a name and/or room number may be used by server 18*a* to access the customer's data stored at server 18*a* as a guest of the hotel. While the term 'hotel' is used herein to describe the customer's place of lodging, such language should be construed as limiting the use of the present invention to such establishments. Data server 18*a* uses customer data, film roll data, and deposit site data to generate a data repository that may accompany the film roll to a processing lab. Film roll data may be entered through a keypad or, if a bar code is affixed to the exterior of the film roll, a bar code reader may be used to read it. The hotel site data identifies the hotel site location and may be stored in server 18*a*. These various data correlate the customer, film roll container, and deposit site to one another. The data repository containing this data may be a label or bar code that may be applied using adhesive to the film roll container for tracking during its transfer to and from a photo processing lab. Preferably, these data are encoded in the data repository so the data are not legible. To further enhance data security, the data may also be encrypted. These data may also be used to generate a data record that is stored in server 18*a*, preferably in a database, for accounting purposes.

As discussed more fully below, notification message system 22 generates and sends to a customer a message informing the customer of the availability of the customer's developed film. Notification system 22 may be a hotel messaging system that displays messages on the television in a guest's room or an automated voice attendant system that manages hotel room voicemail. When notification system 22 is a messaging system, the notification message is a visual text message available to the customer through menu selection by use of the television remote control. When notification system 22 is an automated voice attendant system, server 18*a* sends the notification message to the hotel voicemail box identified by the customer data. When the customer hears the notification that the developed film is available, the customer may retrieve the developed film from the front desk or have it delivered to the guest's room.

Using like numerals for like components, system 10 may also include a processing lab site 24 that may include a lab server 18*b* operatively coupled to a data capture device 20*b*. While lab server 18*b* and data capture device 20*b* may be identical to those at hotel site 14, they need not necessarily be the same. They should be capable of reading and processing data generated by one another if servers at each site are used to implement the present invention. In an embodiment of the present invention, servers 14*a* and 14*b* may be computer systems that use Pentium processors operating at 266 MHz, having 64 MB of RAM and a hard disk storage capacity of 4.3 GB. Servers 14*a* and 14*b* may use the Windows 95 or higher operating system or equivalent. Data capture device 20*a* and 20*b* may be a barcode reader such as a 7890 model barcode scanner manufactured by NCR of Duluth, Ga. or a keypad such as the keyboard of server 14*a* or 14*b* or a keypad such as model 5100 manufactured by NCR of Columbia, S.C. As discussed more fully below, lab site 24 may or may not include a notification message system 22 when a lab site 24 is used to implement the present invention.

At lab site 24, data capture device 20*b* reads the data repository accompanying a film roll container delivered to the site. This data may be stored in server 18*b*, preferably in a database, to track the status of the film roll processing at site 24. An alternative repository may be generated by server 18*b* to accompany the film roll during processing or the film roll container and its accompanying data repository may remain associated with the film during the film development process. Server 18*b* may also generate an electronic status message for transmission to server 18*a*. The communication of the status message may be made via a point-to-point communication path through a dial-up modem connection or it may be provided through an email service over a global computer communication network 28 such as the Internet. Server 18*a* may use status messages to update the status of the film container identified in the corresponding data record being maintained at server 18*a*.

After development of a roll of film, data capture device 20*b* may be used to read the data repository accompanying the developed film roll and update the status of the corresponding data record stored in server 18*b*. Again, server 18*b* may generate an electronic status message for communication to server 18*a* and server 18*a* may also update the status of the corresponding data record kept at server 18*a*. At shipment of the developed film roll, a data repository is associated with the developed film. This repository may be a portion of the original data repository generated by server 18*a*, such as a detachable segment, or another data repository generated by server 18*b*. Server 18*b* may again update its corresponding data record and send messages regarding shipment of the developed roll to server 18*a*.

Upon receipt of the developed roll at hotel site 14, data capture device 20*a* may be used to read the accompanying data repository and update its corresponding data record. Server 18*a* may then generate a message for transmission to server 18*b* indicating successful receipt of the developed film. In response, server 18*b* may delete the corresponding data record or archive the data for further auditing procedures. In accordance with the principles of the present invention, server 18*a* generates a notification message that indicates the developed film is ready for retrieval. This message is sent to notification message system 22 for delivery to the customer identified in the message generated from the customer data. The message may be a visual text message that may be accessed by a guest through the television remote control. The notification text message is sent to the room number identified by the customer data stored in server 18*a*.

In another embodiment of the present invention, the notification message may be an audible message that may be delivered through an automated voice attendant system. When notification message system 22 is an automated voice attendant system, the message is stored for access in the guest voicemail box reserved for the guest identified by the customer data. Upon accessing hotel voicemail to check for voicemail messages, the customer may learn that the developed film is ready for retrieval at the front desk. Upon retrieval, server 18*a* may be notified through data capture device 20*a* or other data entry method.

Regardless of the implementation of notification system 22 used in system 10, server 18*a* updates the corresponding data record maintained in its database to reflect the sending of a notification message to the customer identified by the record. Server 18*a* may periodically audit the data records stored in the database to determine whether a notified customer has not retrieved developed film delivered to hotel site 14. Upon detection of such an event, server 18*a* may generate another notification message to the customer and send it to system 22 for delivery to the customer. Preferably, the message informs the customer of the prior notification. After some reasonable number of notification messages have been sent, server 18*a* may generate a log of developed film rolls that have not been retrieved for review by a human operator. Upon retrieval of a developed roll by a customer, server 18*a* is notified so the corresponding data record may be deleted from the database or archived for other audit purposes.

The system of the present invention may be implemented with the components at hotel site 14 alone or a combination of the components at sites 14 and 24. If the components at site 14 are used alone, the data repository generated by server 18*a* accompanies the film roll to site 24 and back. Upon return of the developed roll, server 18*a* updates the status of the corresponding data record and generates a notification message that is delivered by system 22 to the user. When servers are used at both sites, data server 18*b* is primarily used to track a film roll during processing at site 24 and to provide status messages to server 18*a* so that server may update the status stored in its data records.

Figure 2A:
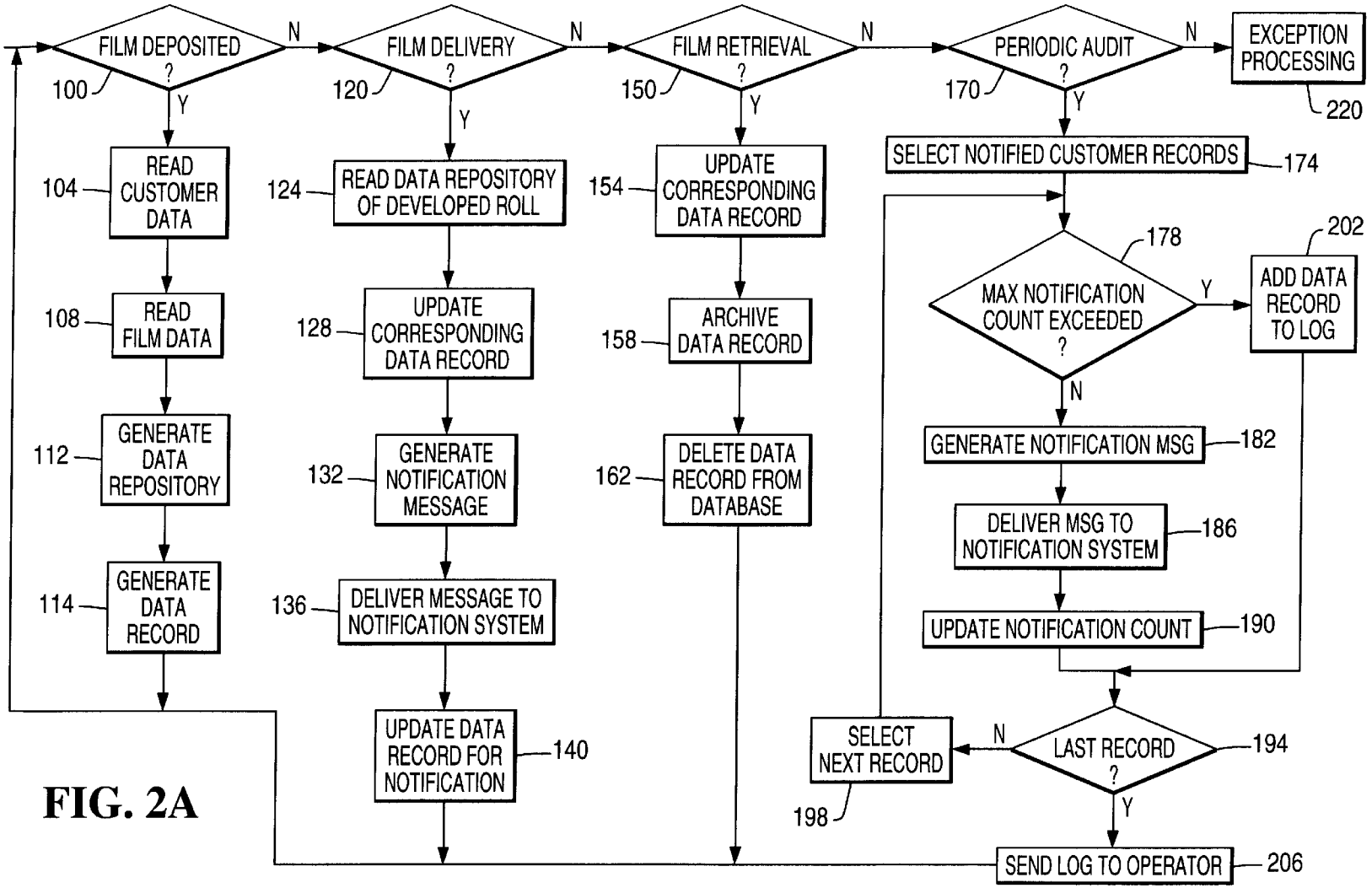
FIG. 2A is a flowchart of an exemplary method for generating customer notification messages regarding availability of developed film rolls for retrieval.

An exemplary method implemented by server 18*a* in accordance with the principles of the present invention is shown in FIG. 2A. The method begins by determining whether an itinerant has delivered a film roll for processing (Block 100), a developed film roll has been delivered from lab site 24 (Block 120), an itinerant has retrieved a developed film roll (Block 150), or it is time for a retrieval audit of database records (Block 170). Otherwise, an error has occurred and exception processing takes place (Block 220). In response to determining that data capture device 20*a* is providing data for film being deposited by an itinerant (Block 100), server 18*a* reads customer data (Block 104) and film roll data (Block 108) to generate a data repository to accompany the film roll (Block 112). A data record is also generated from these data and data corresponding to hotel site 14 (Block 114). The data record is preferably stored in a database coupled to server 18*a*. Server 18*a* continues to scan for data events.

In response to data capture device 20*a* providing data from a developed film roll delivered from a processing lab (Block 120), server 18*a* reads the data obtained by data capture device 20*a* from the data repository accompanying the developed film roll (Block 124). The delivery status of the film roll is updated in the corresponding data record of the database (Block 128). A customer notification message is generated (Block 132) and sent to notification system 22 for delivery to the customer identified by the corresponding database record (Block 136). The database record is updated to indicate a notification message has been sent to the customer (Block 140) and server 18*a* continues to scan for data events.

In response to being notified that a customer has retrieved a developed film roll (Block 150), server 18*a* updates the retrieval status of the corresponding database record (Block 154) and archives the record (Block 158). The database record is then deleted (Block 162).

In response to a determination that a periodic audit of database records for developed film rolls that have not been retrieved should occur (Block 170), server 18*a* selects the database records indicating customer notification has occurred without film roll retrieval (Block 174). For a record in the group of selected records, server 18*a* determines whether the maximum number of customer notifications have already occurred (Block 178). If the maximum number of notifications has not occurred, another notification message is generated (Block 182) and delivered to notification system 22 (Block 186). The customer notification count in the database record is updated (Block 190). If any record indicates the maximum number of customer notifications has been exceeded (Block 178), the data content of the record is added to the log of film rolls not retrieved by notified customers (Block 202). After a database record from the group of selected records has been processed, server 18*a* checks to determine whether additional audit records remain (Block 194). If there are remaining records to process, another record is selected (Block 198) and the process continues (Block 178). Otherwise, the log of developed film rolls that have not been retrieved by notified customers is sent to an operator (Block 206) and server 18*a* continues to scan for data events.

Figure 3:
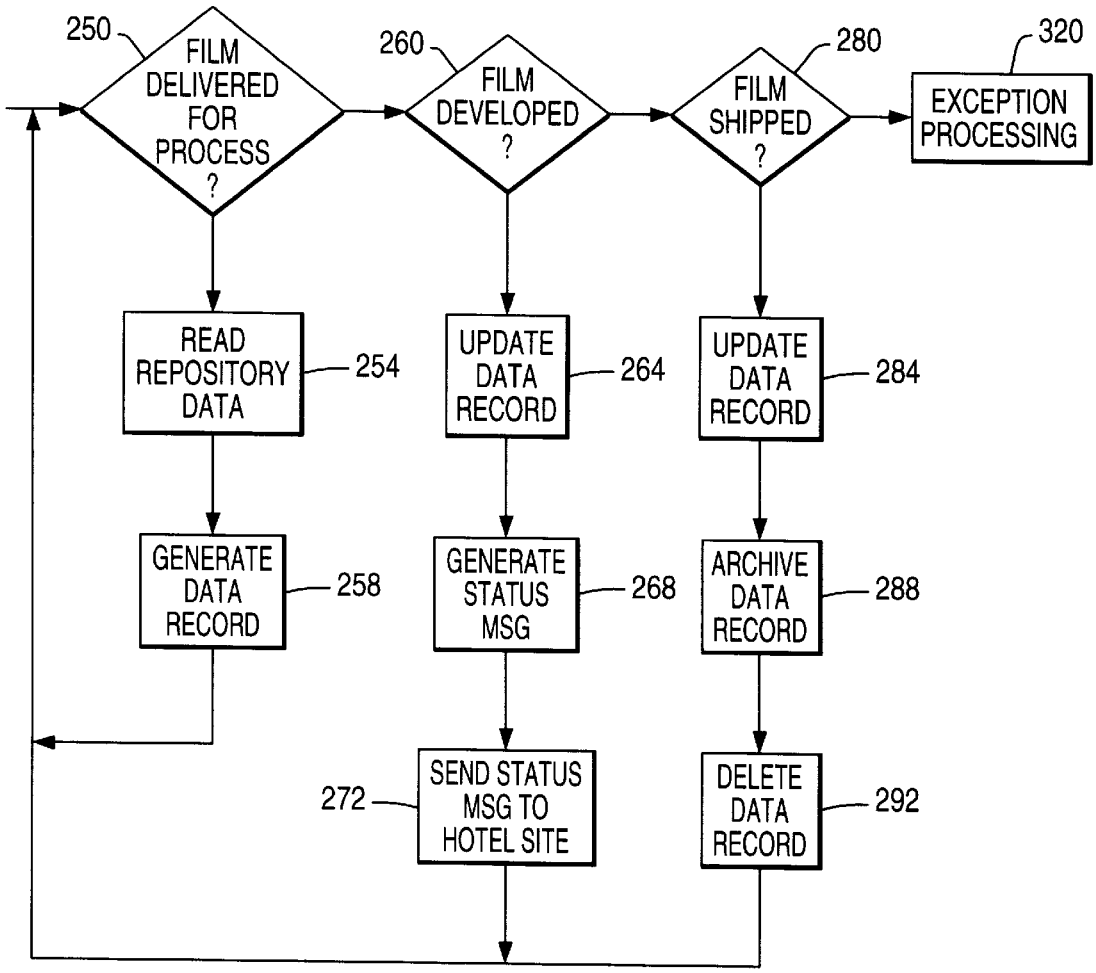
FIG. 3 is a flowchart of an exemplary method for generating and sending messages to a deposit site regarding the processing of a film roll at a processing lab.

An exemplary method implemented by server 18*b* in accordance with the principles of the present invention is shown in FIG. 3. The method begins by determining whether a film roll has been delivered for processing (Block 250), a film roll has been developed (Block 260), or a developed film roll has been shipped to its corresponding hotel site (Block 280). Otherwise, an error has occurred and exception processing takes place (Block 320). In response to determining that data capture device 20*b* is providing data for a film roll being delivered for processing (Block 250), server 18*b* reads the data repository accompanying the film roll (Block 254) to generate a data record corresponding to the delivered film roll (Block 258). The data record is preferably stored in a database coupled to server 18*b*. A data repository to accompany the film roll during processing at lab site 24 may be generated by server 18*b* if the data repository accompanying the delivered film roll is removed from the film roll after being read by data capture device 20*b*. Server 18*b* continues to scan for data events.

Figure 2B:
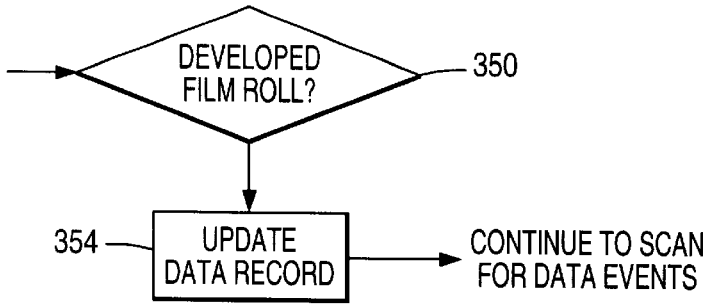
FIG. 2B is a flowchart of an exemplary method for processing status messages from a processing lab server regarding development of a film roll.

In response to data capture device 20*b* providing data corresponding to a film roll developed at lab site 24 (Block 260), server 18*b* updates the processed status in the corresponding data record (Block 264). A message notifying hotel site 14 of the developed status of the film roll may be generated (Block 268) and sent to server 18*a* (Block 272). If server 18*b* generates such a message, the data event processing shown in FIG. 2B is added to the server 18*a* processing shown in FIG. 2A. In that scenario, server 18*a* determines whether a developed film roll message has been received (Block 350, FIG. 2B) so the corresponding data record may be updated (Block 354, FIG. 2B). The developed film roll message is another data event for which server 18*a* scans. After processing the notification that a film roll has been developed (Blocks 260–272, FIG. 3), server 18*a* continues to scan for data events.

In response to being notified that a developed film roll has been shipped to its corresponding hotel site (Block 280), server 18*b* updates the shipped status of the corresponding data record (Block 284) and archives the record (Block 288). The database record is then deleted (Block 292). As discussed above with respect to the sending of a message to server 18*a* regarding development of a film roll, server 18*b* may also generate and send messages to server 18*a* regarding receipt of a film roll for processing and/or shipment of a developed film roll. If server 18*b* generates and sends such messages, they are processed by server 18*a* in a manner similar to that indicated for the processing of developed film roll messages as shown in FIG. 2B.

Figure 4:
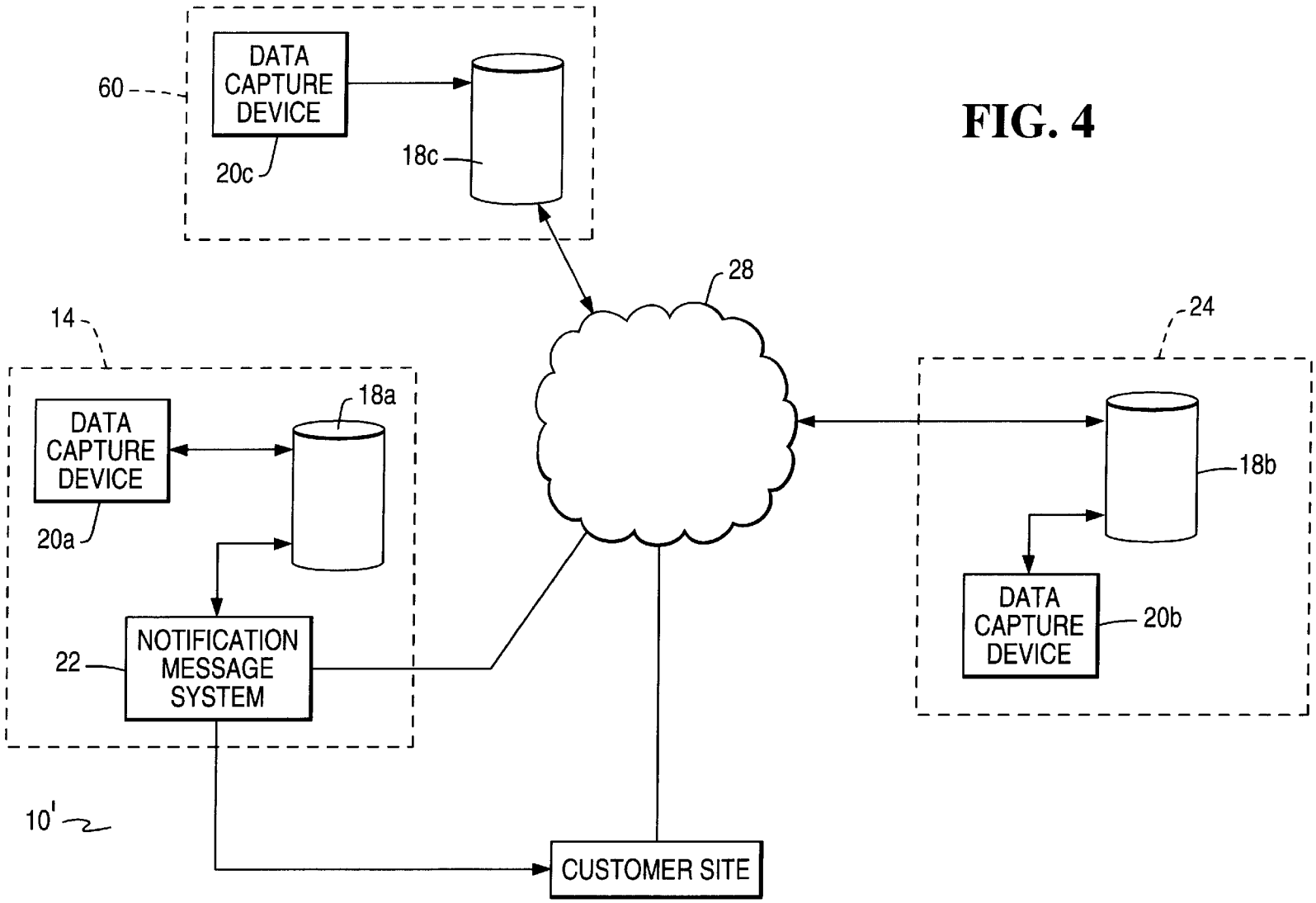
FIG. 4 is a block diagram of a system that may be used to notify an itinerant that a developed film roll deposited at a point-of-interest site for development is available for retrieval.

System 10 described above with respect to film rolls being deposited with a hotel site for development may be modified for handling film rolls deposited at a theme park or other point-of-interest site. Such a system is shown in FIG. 4. Using like numerals to identify like components, system 10' includes hotel site 14 and lab site 24 with the addition of remote site 60 that may be located at a theme park or other point-of-interest site. Site 60 includes a data capture device 20*c* and a data server 18*c*. Data capture device 20*c* operates in a manner similar to that described with respect to 20*a* in reading an electronic room key for customer identification data when an itinerant deposits a film roll at site 60. Server 18*c* generates a data repository and data record from the customer identification data, film roll data, and remote site data. Server 18*c* also generates a deposit message identifying the itinerant and film data and sends the message to hotel site 14. The message may be delivered via global computer network 28 or through a point-to-point method. In response, hotel site 14 may generate a data record for tracking the status of a guest's film roll during processing.

Upon receipt of a film roll and data repository at site 24, data capture device 20*b* reads the data repository so server 18*b* may generate a data record for tracking the roll while it is being processed. Server 18*b* also sends a status message to servers 18*a* and 18*c*. Server 18*a* updates the status of its corresponding record and server 18*c* archives and deletes its corresponding record after updating the record in response to the status message. Thereafter, system 10' operates in much the same way as system 10. That is, the status messages regarding development and shipment of the roll are sent to hotel site 14 and hotel site 14 notifies the itinerant upon receipt of the developed roll as described above.

Figure 5:
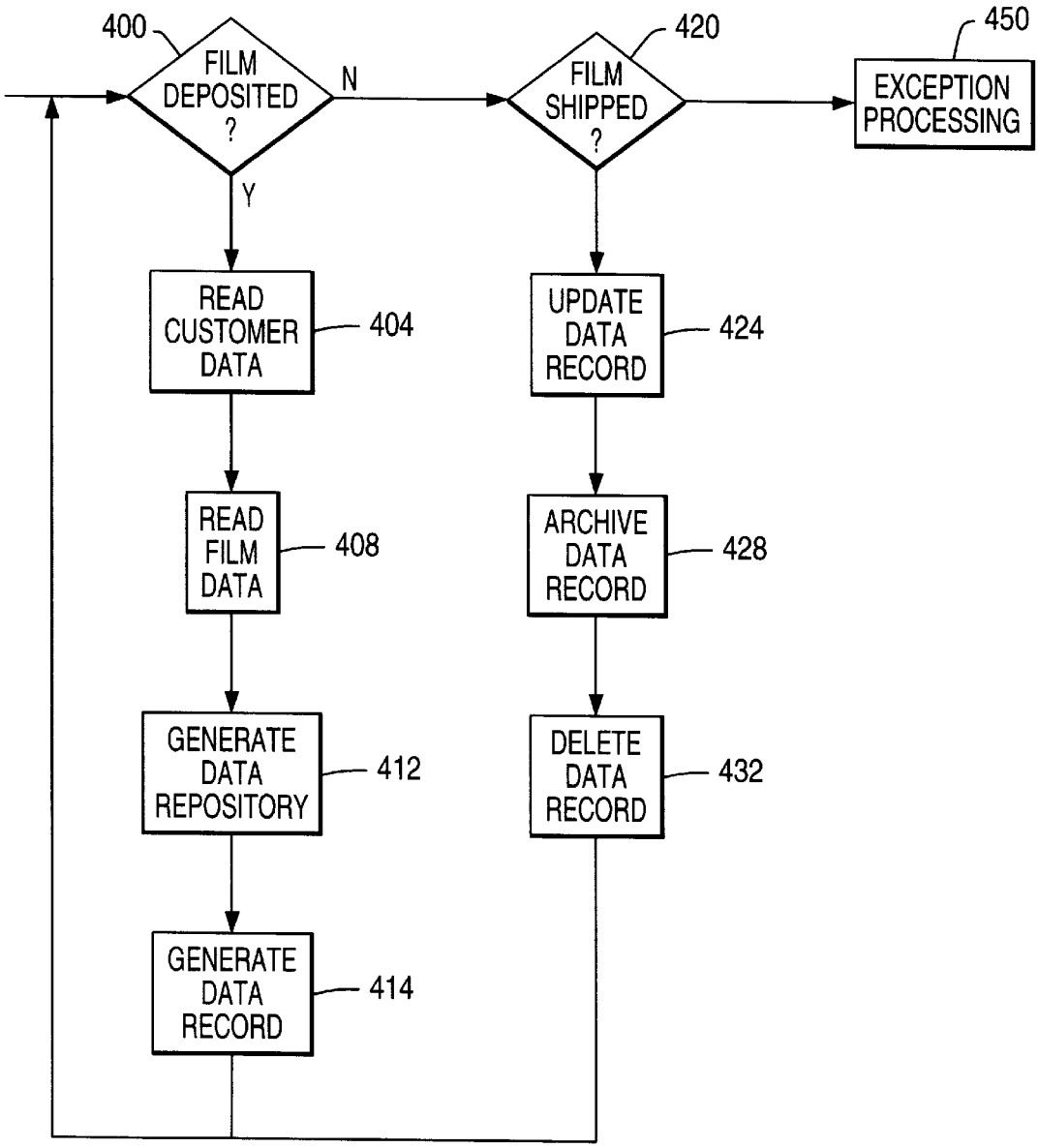
FIG. 5 is a flowchart of an exemplary method for tracking a film roll deposited at a point-of-interest site until the roll is received at a processing site.

An exemplary method implemented by server 18*c* in accordance with the principles of the present invention is shown in FIG. 5. The method begins by determining whether an itinerant has deposited a film roll for processing (Block 400) and whether a film roll sent from site 60 has been received at lab site 24 (Block 420). Otherwise, an error has occurred and exception processing takes place (Block 450). In response to determining that data capture device 20*c* is providing data for film being deposited by an itinerant (Block 400), server 18*c*reads customer data from an electronic room key (Block 404) and film roll data (Block 408) to generate a data repository to accompany the film roll (Block 412). A data record is also generated from these data and data corresponding to remote site 60 (Block 414). The data record is preferably stored in a database coupled to server 18*c*. Server 18*c* continues to scan for data events.

In response to being notified by a status message that lab site 24 has received a film roll from remote site 60 (Block 420), server 18*c* updates the receipt status of the corresponding database record stored at server 18*c* (Block 424) and archives the record (Block 428). The database record is then deleted (Block 432). Although not shown, server 18*c* may perform a periodic audit of its database records to determine whether any film rolls shipped from remote site 60 have not been received by site 24. Upon detection of any shipped film rolls not being received, the operator receiving the log may resolve the matter with the shipper and resolution of the matter provided to hotel site 14 so the database there may be properly updated.

While the present invention has been illustrated by the description of exemplary processes, and while the various processes have been described in considerable detail, it is not the intention of the applicant to restrict or in any limit the scope of the appended claims to such detail. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A system for itinerants who deposit film rolls at a hotel site for development that a film roll is available for retrieval comprising:

a first data capture device for reading customer identification data from an electronic room key and film roll data from a film roll;

a first data server for storing data in a data repository; and a notification message generator for generating a notification message to an itinerant corresponding to the customer identification data, said notification message being generated in response to data being received that indicates a developed film roll corresponding to said film roll data has been received at a hotel site identified by said data stored in said data repository that accompanies said developed film roll.

2. The system of claim 1 further comprising:

a second data server located at a film processing site; and a second data capture device located at said film processing site.

3. The system of claim 1 wherein said notification message generator is a hotel text messaging system accessible through a guest's television.

4. The system of claim 1 wherein said notification message generator generates an audible message for delivery of said audible message to a telephone corresponding to said customer identification data that is located at said hotel site.

5. The system of claim 1 wherein said data server encodes data stored in said data repository.

6. A method for notifying an itinerant who deposits a film roll at a hotel site for development that the developed film roll is available for retrieval at the hotel site comprising:

reading customer identification data from an electronic room key;

storing said customer identification data with film data in a data repository that accompanies a film roll container;

reading customer identification data from said data repository after development of the film roll in the film container; and generating a notification message for delivery to an itinerant corresponding to said customer identification data, said notification message informing said itinerant that a developed film roll is available for retrieval at a hotel site.

7. The method of claim 6 further comprising:

delivering said notification message to a television located in a guest room identified by said customer identification data.

8. The method of claim 6 further comprising:

delivering said notification message to a voicemail box for a guest at a place of lodging identified by said customer identification data.

9. The method of claim 6 further comprising:

generating a data record from said data stored in said data repository.

10. The method of claim 6 further comprising:

updating a status of said data record in response to said notification message generator generating a notification message.

11. A system for notifying an itinerant who deposits a film roll at a remote site for development that the developed film roll is available for retrieval at a place of lodging for the itinerant comprising:

a first data capture device located at a remote site for reading customer identification data from an electronic room key and film roll data from a film roll deposited at said remote site;

a first data server for storing data in a data repository and generating a data record from said customer identification data and said film roll data, said data repository accompanying said film roll to a film processing site for development and said first data server sending a message to a place of lodging regarding said deposit of said film roll at said remote site.

12. The system of claim 11 further comprising:

a second data server located at a film processing site; and a second data capture device located at said film processing site, said second data server sending a status message to said first data server and said place of lodging regarding receipt of said film roll for development at said film processing site.

13. The system of claim 12 further comprising:

a third data capture device located at said place of lodging;

a third data server located at said place of lodging; and a notification message generator for generating a notification message to an itinerant corresponding to the customer identification data, said notification message being generated in response to data being received that indicates a developed film roll corresponding to said film roll data has been received at said place of lodging corresponding to said data in said data repository accompanying said developed film roll received at said place of lodging.

14. The system of claim 13 wherein said notification message generator is a hotel text messaging system accessible through a guest's television.

15. The system of claim 11 wherein said notification message generator generates an audible message for delivery of said audible message to a telephone corresponding to said customer identification data that is located at said hotel site.

16. A method for notifying an itinerant who deposits a film roll at a remote site for development that the developed film roll is available for retrieval at a place of lodging for the itinerant comprising:

reading customer identification data from an electronic room key at a remote site;

storing said customer identification data with film data in a data repository that accompanies a film roll container shipped from said remote site to a film processing lab;

reading customer identification data from said data repository after development of the film roll in the film container; and generating a notification message for delivery to an itinerant corresponding to said customer identification data, said notification message informing said itinerant that a developed film roll is available for retrieval at said itinerant's place of lodging.

17. The method of claim 16 further comprising:

delivering said notification message to a television located in a guest room identified by said customer identification data.

18. The method of claim 16 further comprising:

delivering said notification message to a voicemail box for a guest at a place of lodging identified by said customer identification data.

19. The method of claim 16 further comprising:

generating at said remote site a data record from said data stored in said data repository.

20. The method of claim 19 further comprising:

deleting said data record in response to a message indicating said film roll corresponding to said data record has been received at said film processing site.

* * * * *